US008696202B2

(12) United States Patent
Ackerman et al.

(10) Patent No.: US 8,696,202 B2
(45) Date of Patent: Apr. 15, 2014

(54) POUCH WITH CONNECTORS AND SYSTEM OF SUCH POUCHES

(75) Inventors: Bryan L. Ackerman, Freeland, MI (US); Bethanne L. Valentine, Saginaw, MI (US); Nancy F. Dewane, Waterford, WI (US); Imtiaz A. Musaliar, Racine, WI (US); Larry T. Schmitt, Franklin, WI (US); Maria Economopoulos Kakis, Park Ridge, IL (US); Lucas Daniel, Chicago, IL (US); Ann Hintzman, Chicago, IL (US); David J. VandenBranden, Chicago, IL (US); Sarah I. Garcia, Chicago, IL (US); Moritsugu Kariya, Chicago, IL (US); Scott Ternovits, Chicago, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 217 days.

(21) Appl. No.: 13/156,074

(22) Filed: Jun. 8, 2011

(65) Prior Publication Data

US 2012/0301055 A1 Nov. 29, 2012

Related U.S. Application Data

(60) Provisional application No. 61/489,145, filed on May 23, 2011.

(51) Int. Cl.

| | |
|---|---|
| ***B65D 30/22*** | (2006.01) |
| ***B65D 33/10*** | (2006.01) |
| ***B65D 33/14*** | (2006.01) |
| ***B65D 33/06*** | (2006.01) |
| ***B65D 33/24*** | (2006.01) |
| ***B65D 33/04*** | (2006.01) |

(52) U.S. Cl.
USPC ..... 383/39; 383/9; 383/23; 383/26; 383/86; 383/106

(58) Field of Classification Search
USPC ..... 383/37–39, 9, 106; 229/69, 72; 402/78, 402/80 P
See application file for complete search history.

(56) References Cited

U.S. PATENT DOCUMENTS

| | | | | |
|---|---|---|---|---|
| 16,829 | A | 3/1857 | French | |
| 900,751 | A * | 10/1908 | Lockwood | 229/72 |
| 915,452 | A | 3/1909 | Litts | |
| 1,254,966 | A | 1/1918 | Bens | |
| 1,314,688 | A | 9/1919 | Moss | |
| 1,402,951 | A | 1/1922 | Olson | |
| 1,541,563 | A * | 6/1925 | Graham | 206/578 |
| 1,792,862 | A * | 2/1931 | Oyler | 150/134 |
| 2,159,279 | A | 5/1939 | Lipowsky et al. | |
| 2,322,688 | A * | 6/1943 | Glick | 383/6 |
| 2,356,078 | A * | 8/1944 | Myers | 118/500 |
| 2,441,415 | A * | 5/1948 | Hoishman | 383/39 |

(Continued)

*Primary Examiner* — Jes F Pascua

(57) ABSTRACT

A pouch has a connection structure that includes a female connector and a male connector. The male connector of the pouch is configured to snap-fit with another female connector that has the same configuration as the female connector, and the female connector is configured to receive by snap-fit another male connector that has the same configuration as the male connector. A system of pouches can be provided the male and female connectors on a common backing panel. The connectors are also configured to allow the connected pouches to pivot relative to each other such that the pouches can be displayed in a fan-like arrangement, and accessories can be provided though passages in the connectors.

22 Claims, 9 Drawing Sheets

(56) References Cited

U.S. PATENT DOCUMENTS

| | | | | | |
|---|---|---|---|---|---|
| 2,560,932 | A | | 7/1951 | Chapman et al. | |
| 2,653,751 | A | | 9/1953 | Vogt | |
| 2,653,752 | A | | 9/1953 | Vogt | |
| 2,671,602 | A | | 3/1954 | Vogt | |
| 2,681,677 | A | | 6/1954 | Poeltl | |
| 2,688,435 | A | | 9/1954 | Vogt | |
| 2,715,493 | A | | 8/1955 | Vogt | |
| 2,871,901 | A | | 5/1957 | Nash | |
| 2,803,281 | A | * | 8/1957 | Sutton | 150/138 |
| 3,078,897 | A | | 2/1963 | Rifkin | |
| 3,087,498 | A | * | 4/1963 | Vogel | 402/22 |
| 3,100,569 | A | | 8/1963 | White | |
| 3,124,187 | A | | 3/1964 | Bosca et al. | |
| 3,160,936 | A | | 12/1964 | Kapp | |
| 3,175,231 | A | | 3/1965 | Magario et al. | |
| 3,198,325 | A | | 8/1965 | White | |
| 3,231,901 | A | | 2/1966 | Kennedy | |
| 3,283,992 | A | | 11/1966 | Hanson et al. | |
| 3,400,591 | A | | 9/1968 | Larson | |
| 3,827,551 | A | | 8/1974 | Croft | |
| 4,456,122 | A | | 6/1984 | Kalal | |
| RE32,443 | E | | 6/1987 | Kalal | |
| 4,685,570 | A | * | 8/1987 | Medow | 206/579 |
| 4,738,547 | A | * | 4/1988 | Brown | 383/39 |
| 4,995,436 | A | | 2/1991 | Cantor | |
| 5,050,713 | A | | 9/1991 | Lee | |
| D324,305 | S | | 3/1992 | Prey | |
| 5,092,682 | A | | 3/1992 | Fenick | |
| 5,305,935 | A | | 4/1994 | Weiner | |
| 5,358,280 | A | | 10/1994 | Scales | |
| 5,647,107 | A | | 7/1997 | Brewster | |
| 5,692,837 | A | | 12/1997 | Beer | |
| 5,722,126 | A | | 3/1998 | Reiter | |
| 5,947,241 | A | | 9/1999 | Rausch | |
| 6,012,557 | A | | 1/2000 | Derelanko | |
| 6,224,258 | B1 | | 5/2001 | Dodson | |
| 6,233,782 | B1 | | 5/2001 | Regele et al. | |
| 6,471,402 | B1 | | 10/2002 | Burns | |
| 6,536,951 | B1 | | 3/2003 | Sill | |
| 6,575,300 | B2 | | 6/2003 | Meyer | |
| 7,097,358 | B2 | | 8/2006 | Keith et al. | |
| 7,150,081 | B2 | | 12/2006 | Juan | |
| 8,016,111 | B2 | | 9/2011 | Wilson et al. | |
| 8,109,672 | B1 | * | 2/2012 | Ackerman et al. | 383/37 |
| 2008/0031551 | A1 | | 2/2008 | Jones | |
| 2009/0034885 | A1 | | 2/2009 | McGruder | |
| 2009/0074331 | A1 | | 3/2009 | Plank et al. | |
| 2009/0077842 | A1 | | 3/2009 | Plank et al. | |
| 2010/0142861 | A1 | | 6/2010 | Sam | |
| 2010/0142862 | A1 | | 6/2010 | Sam | |
| 2010/0159096 | A1 | | 6/2010 | Sam | |
| 2010/0254632 | A1 | | 10/2010 | Schneider | |

* cited by examiner

POUCH WITH CONNECTORS AND SYSTEM OF SUCH POUCHES

This application claims priority to U.S. Provisional Patent Application No. 61/489,145, filed May 23, 2011.

BACKGROUND

1. Field of the Invention

Our invention relates to a pouch, and a corresponding system of pouches that can be connected together. More specifically, our invention relates to pouches that include male connectors and female connectors, wherein the male connectors and female connectors are configured to snap-fit together to connect the pouches.

2. Related Art

Nowadays, an increasing number of tasks must be completed at both home and work. The head or heads of a household are now faced with chores such as managing schedules, planning meals, and tracking active projects, all of which must be completed within a limited amount of time. Meanwhile, at work, many of these same heads of households are responsible for completing numerous tasks. Careful planning and organization are therefore required to ensure that everything is completed, and that things are not lost in the shuffle.

A variety of products are made with the goal of aiding day-to-day organization, particularly in the area of containing and grouping items. In general, there are two types of such organizational tools available to consumers: general receptacles meant to hold anything put in them, and specific tools that prescribe a solution to a narrowly defined set of materials or activities. These tools include folders, pockets, envelopes, securing systems such as binders, labels, label makers, etc. While many of these organizational tools are helpful for managing one type of item, a multi-purpose functionality is often lacking in these devices. For example, a conventional folder is designed to securely hold papers. The conventional folder, however, cannot be connected with another folder, absent a separate structure such as a binder or drawer-type filing system. Moreover, the conventional folder is not readily adaptable to hold items other than paper, and is often made from opaque materials that obscure its contents. Further, while multi-folder accessories, such as a binder, a filing cabinet, or a file folder are able to contain multiple files, there is no ability to quickly, easily, and effectively separate a particular folder of interest from such accessories, nor the ability to quickly, easily, and effectively create new folder combinations from multiple folder sets with such accessories.

Thus, there is a need for organizational tools that are easily associated with similar organizational tools. In particular, there is a need for organizational tools that can contain diverse items, with the contents of the tools being easily discernable.

SUMMARY OF THE INVENTION

The present invention is directed to a pouch and a system of pouches that can be used to contain a variety of items.

In one aspect, our invention is directed to a system of pouches that comprises a backing panel, a first pouch attached to one side of the backing panel, and a second pouch attached to the same side of the backing panel as the first pouch. A first connection structure is connected to the backing panel in an area adjacent to the first pouch, with the first connection structure including (i) a female connector provided on the same side of the backing panel as the first pouch and the second pouch, and (ii) a male connector provided on a side of the backing panel that is opposite to the side with the female connector. A second connection structure is connected to the backing panel in an area adjacent to the second pouch, the second connection structure including (i) a male connector provided on the same side of the backing panel as the female connector of the first connection structure, and (ii) a female connector provided on the side of the backing panel with the male connector of the first connection structure. The backing panel is configured to fold along a crease in an area between the first pouch and the second pouch, the backing panel folding from a position where (i) the female connector of the first connection structure and the male connector of the second connection structure are separated from each other, to (ii) a position where the female connector of the first connection structure receives the male connector of the second connection structure.

In another aspect, our invention is directed to a pouch comprising a first panel, with a female connector positioned adjacent to the first panel. The pouch also comprise a second panel associated with the first panel so as to form an enclosed space between the first panel and the second panel, and a male connector is positioned adjacent to the second panel. The female connector and the male connector are separate structures, and the female connector and the male connector are positioned adjacent to different corners of the pouch. The male connector is configured to snap-fit with another female connector that has the same configuration as the female connector, and the female connector is configured to receive by snap-fit another male connector that has the same configuration as the male connector.

In yet another aspect, our invention is directed to a pouch comprising a first panel, with a first connector positioned adjacent to the first panel. The pouch further comprises a second panel associated with the first panel so as to form an enclosed space between the first panel and the second panel, and a second connector is positioned adjacent to the second panel. The first connector and the second connector are separate structures, and the first connector and the second connector are positioned adjacent to different corners of the pouch. The first connector is configured to receive, with a releasable connection, a third connector that has the same configuration as the second connector, and the second connector is configured to receive, with a releasable connection, a fourth connector that as the same configuration as the first connector.

DETAILED DESCRIPTION OF THE INVENTION

Figure 1:
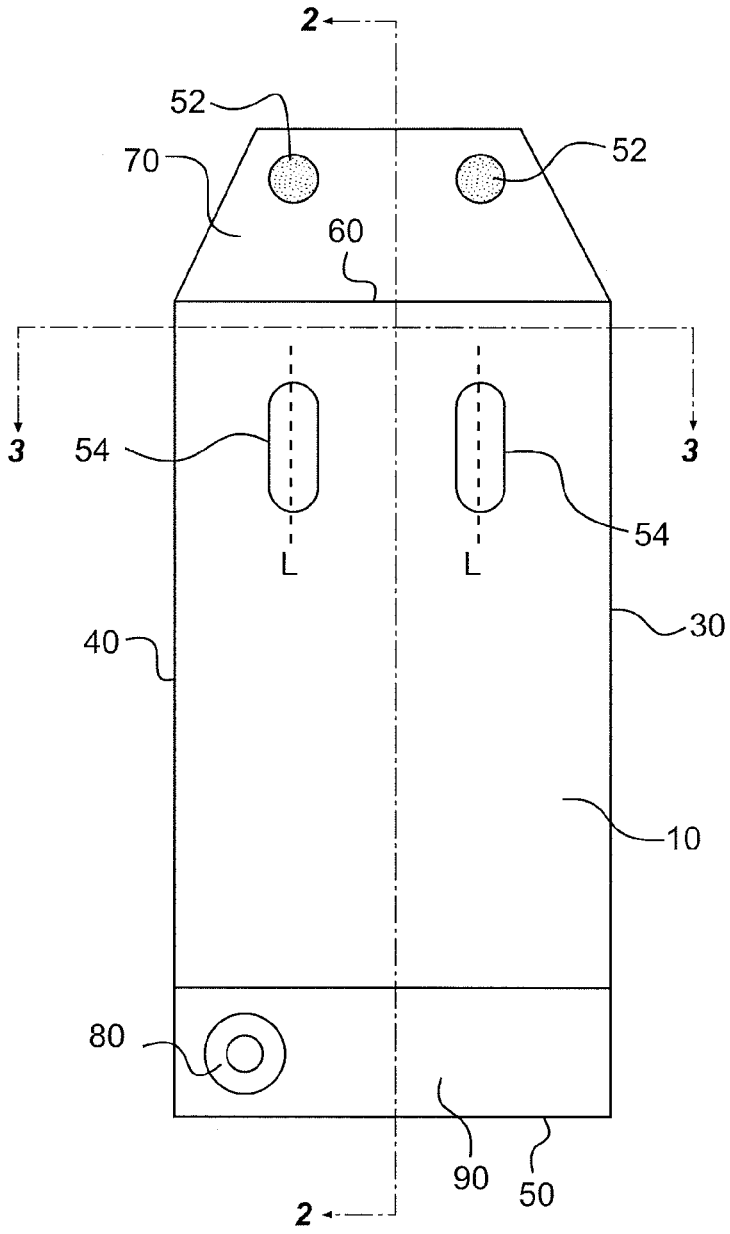
FIG. 1 is a top view of a pouch according to an embodiment of the invention.

The present invention is directed to a pouch with a connection structure. The connection structure includes a male connector and a female connector that allow the pouch to be connected to another pouch with corresponding male and female connectors. The connection structures of the pouches are also configured to allow the pouches to pivot relative to each other such that the connected pouches can be displayed in a fan-like arrangement.

As will be apparent from the description herein, the term "pouch" encompasses a broad range of structures designed to contain items, such as envelopes bags, packets, and the like.

As will be described below, a pouch according to the invention includes a female connector and a male connector. A "female connector," as used herein, means a connection structure that receives another connection structure. A "male connector," as used herein, means a connection structure that is provided to another connection structure. Notably, a single connection structure could include both a female connector and a male connector, and the male and female parts could be positioned in any manner relative to each other in the connection structure.

A pouch according to an embodiment of the invention is shown in FIGS. 1-4. The pouch includes a first panel 10 and a second panel 20. The panels 10 and 20 are connected together by a first side wall 30 and a second side wall 40. The panels 10 and 20 are also connected along side 50 of the pouch. An enclosed space is thereby formed between the panels. An opening 60 is provided to the enclosed space along the side of the pouch opposite to the side 50.

The pouch also includes a flap 70 extending from the second panel 20. The flap 70 is movable between an extended position wherein the opening 60 to the enclosed space is accessible, and a folded position wherein the flap 30 is positioned adjacent to the first panel 10. In the folded position, the flap 30 closes the opening 60 to the enclosed space of the pouch. In an alternative configuration (not shown), the flap extends from the first panel and is folded adjacent to the second panel.

The flap 70 includes attachment structures 52 that are positioned to corresponding attachment structures 54 on the first panel 10 when the flap 70 is in the folded position. The attachment structures 52 and 54 provide a connection between the flap 70 and the first panel 10. In one embodiment, the attachment structures 52 and 54 are a hook and loop combination, such as VELCRO® by Velcro USA, Inc. of Manchester, N.H. It should be noted that while the depicted pouch includes two attachment structures, one pair of attachment structures, or more than two pairs of attachment structures could be provided. Moreover, those skilled in the art will recognize that the attachment structures 50 and 55 could take a variety of forms equivalent to a hook and loop combination, such as buttons, zippers, or adhesive structures. Specific examples of other attachment structures are the resealable structures used in ZIPLOC® storage bags by S.C. Johnson & Inc. of Racine, Wis.

Figure 4A:
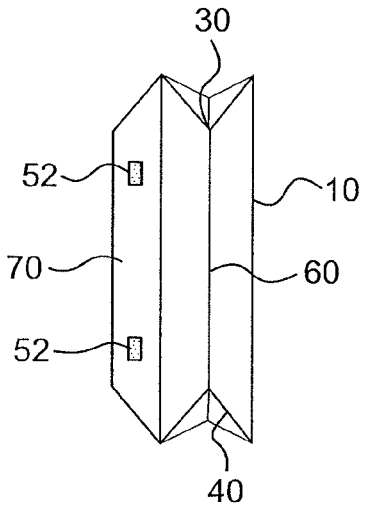
FIG. 4A is a cross-sectional view of the pouch shown in FIG. 1 in an unexpanded configuration.
Figure 4B:
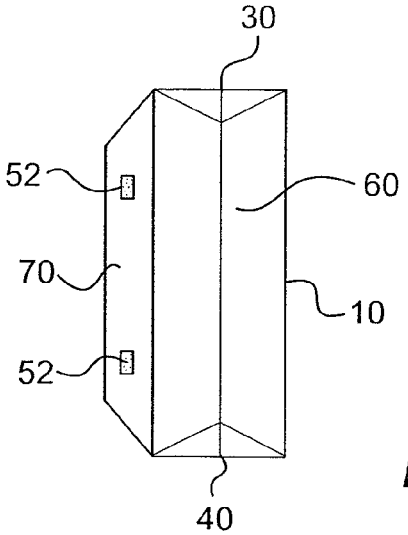
FIG. 4B shows a cross-sectional view of the pouch shown in FIG. 1 in an expanded configuration.

As shown in FIGS. 4A and 4B, the side wall 30 and the side wall 40 provide a gusset-type connection, i.e., expandable, between the first panel 10 and the second panel 20. The gusset connection allows the relative size of the enclosed space to be changed from a size with the first panel 10 and the second panel 20 proximate to each other, and an expanded state wherein the first panel 10 and the second panel 20 are separated from each other. In the relatively narrow state, the pouch assumes a substantially flat configuration, whereas in the expanded state, the pouch can accommodate larger objects in the enclosed space.

The attachment structures 54 provided on the first panel 10 of the pouch may be sized so to accommodate the expandable nature of the pouch. For example, as shown in FIG. 1 the attachment structures 54 have a length extended in the direction L that is longer than the length of the attachment structures 52 on the flap 70. When the first panel 10 and the second panel 20 are proximate to each other, the attachment structures 52 on the flap 70 align to a position on the attachment structures 54 on the first panel 10 that is more towards the side 50 of the pouch. On the other hand, when the first panel 10 and the second panel 20 are in an expanded state, the attachment structures 52 on the flap 70 align to a position on the attachment structures 54 more towards the opening 60 of the pouch. In a specific example, the attachment structures 54 on the first panel 10 have a length of about 2.25 inches, whereas the attachment structures 52 on the flap 70 have a diameter of about 0.75 inches. Of course, the dimensions of the attachment structures can be varied in accordance with the configuration of the rest of the pouch.

The first and second panels 10 and 20, side walls 30 and 40, and the flap 70 may be constructed from materials such as paper, plastic, plastic coated paper, cloth, leather, and wood. In more particular embodiments, the pouch is formed from a thermal plastic such as polyethylene. Alternatively, the pouch may be formed from other types of plastic that are made from renewable resources or are biodegradable, such as bioplastics. Examples of bioplastics include those made from bioployesters polymers such as polyhyroxyalkanoates (PHAs) and poly(lactic acid) (PLA). Further examples of plastics which may come from renewable resources include those that may be originated from sugarcane. Further still, the plastic or paper material forming the pouch may also include a certain amount of recycled content.

A plastic used to form the pouch may be substantially transparent so that the contents of the pouch can be seen without opening the pouch. While still being transparent, the plastic can be tinted to provided one or more colors to the pouch. In alternative embodiments, however, the plastic forming the pouch is made opaque or have an appropriate pattern printed thereon in order to conceal the contents of the pouch. Such pouches may be used to contain confidential items. Techniques for varying the transparency or color of a plastic pouch will be readily apparent to those skilled in the art. In one nonlimiting embodiment, a pouch may have one transparent face and an opposing opaque face. It is thought that by providing such a configuration, the user may be able to easily discern the contents of one pouch from another because, while all the pouches may be visible when the group is fanned out (which is described in greater detail below) the opacity of one side will prevent items from one pouch to appear as though they are in another pouch.

In one specific embodiment of the invention, the pouch is formed from a blown tubular sheet of polyethylene film with a thickness in the range of 2 to 8 mils. The tubular sheet is either initially formed with two gusset structures running the length of the film, or the gusset structures are created in the tubular film through a separate process step. The gusset structures become the side walls 30 and 40 between the panels 10 and 20 in the pouch. The flap 70 is formed by die cutting one end of the tubular sheet. The other end of the tubular sheet is joined together, forming the side 50 of the pouch. There are a variety of techniques known in the art for joining the end of the plastic sheet, such as heat sealing, mechanical welding, or using adhesives.

It should also be noted that while the pouch is formed from a singular sheet of tubular film in the specific embodiment described above, in alternative embodiments, the pouch can be formed from multiple sheets of material. For example, the panels 10 and 20, side walls 30 and 40, and flap 50 could all be formed from separate sheets of plastic material that are joined together to form the final pouch product.

Figure 2:
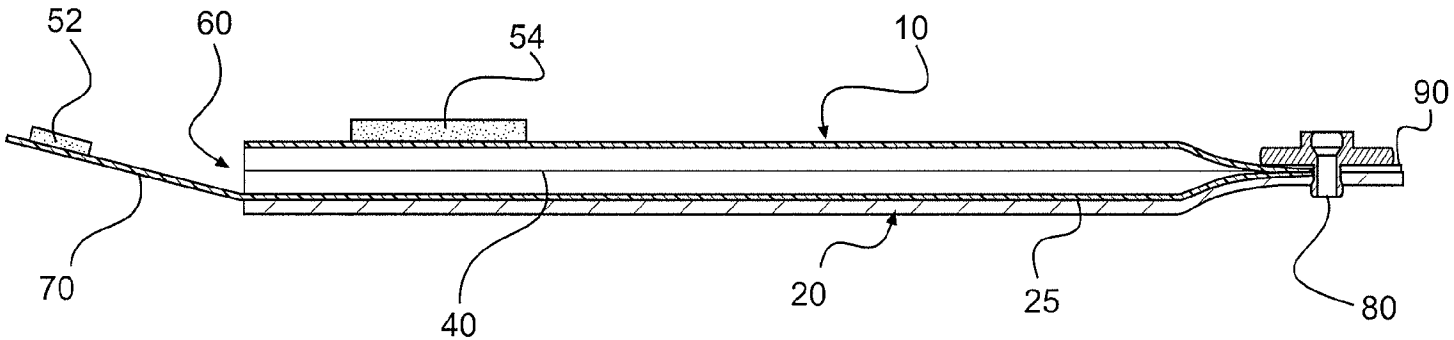
FIG. 2 is a side view of the pouch shown in FIG. 1.
Figure 3:
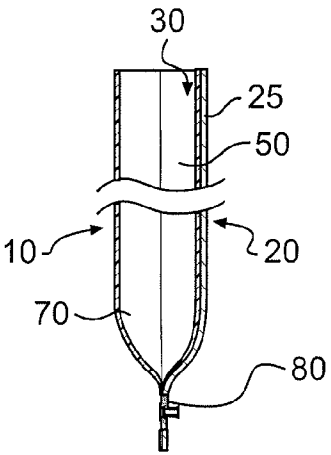
FIG. 3 is another side view of the pouch shown in FIG. 1.
Figure 5A:
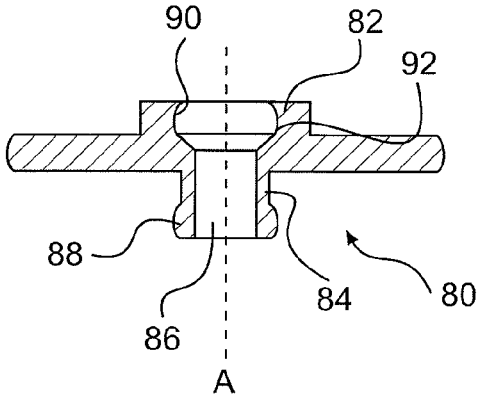
FIG. 5A is a cross-sectional view of a connector for the pouch shown in FIG. 1.

As shown in FIGS. 1-3, a connection structure 80 is provided through a hole at the corner of the pouch adjacent to the second side wall 40 and the third side 50. FIG. 5A shows the details of the connection structure 80. The connection structure 80 is a grommet-like structure that includes a female connector 82. A male structure 84 is formed on a side of the connection structure 80 opposite to the female connector 82. An opening 86 extends through the connector along an axis A between the female connector 82 and the male connector 84.

The connection structure 80 can be made from a variety of materials using a variety of techniques. In one specific example, the connection structure 80 is plastic and formed by injection molding. It should also be noted, however, that while the depicted connection structure 80 is a one-piece integral structure, the female connector 84 and male connector 82 that make up the connection structure 80 could alternatively be separate structures that are not integral to each other. The pouch could also include a plurality of connection structures 80, in order to allow for additional pouches to be connected to the pouch at different places. (The connection of pouches will be described below.) Moreover, the connection structure 80 could be placed at different positions on the pouch, such as in the area 90 adjacent to the side wall 30. The sides from which the female connector 82 and male connector 84 extend could also be reversed, such that the male connector 84 is positioned adjacent to the first panel 10 side of the pouch, and the female connector 82 is positioned adjacent to the second panel 20 side of the pouch. It should also be noted that while the female connector 82 and the male connector 84 in the depicted embodiment have a generally circular shape, the connectors 82 and 84 could take a variety of other, non-circular, shapes, but still possess the functionality described herein. As one example, the female connector and the male connector could take the form of a ball and socket-type connection.

While the connection structure 80 in the depicted embodiment consists of a female connector structure and a male connector structure, those skilled in the art will recognize that a variety of other configurations are possible that still achieve the female and male functionality. For example, in an alternative embodiment, the connection structure attached to the pouch could consist of one of a female connector or a male connector. In this embodiment, a detachable structure is provided to the connection structure attached to the pouch in order to provide the other of the female and male connector. In yet another alternative embodiment, the connection structure on the pouch could include finger-like structures that initially do not specifically define the female and male connection structures. In this embodiment, when a male connector structure is inserted into the connection structure with the finger-like structures, some of the fingers accept the male connection structure, i.e., act as the female connector. At the same time, others of the fingers are moved to a position forming a male connection structure for the pouch.

As will be explained more fully below, the connection structure 80 is configured to allow a plurality of pouches to be connected together. To facilitate such a system of connected pouches, the female connector 82 is configured to receive with a snap-fit another male connector that has the same configuration as the male connector 84. Similarly, the male connector 84 is configured to snap-fit in another female connector that has the same configuration as the female connector 82. With this connector structure configuration, a universal connection system is provided for the system of pouches whereby any one pouch can be connected to either side of another corresponding pouch.

Figure 5B:
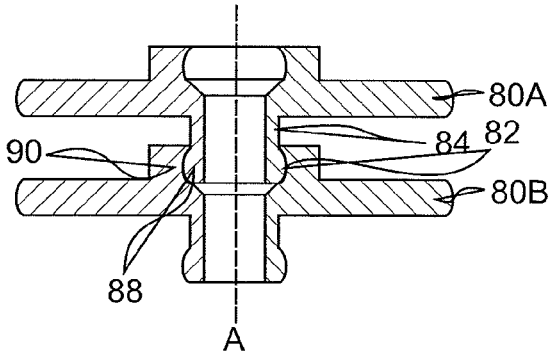
FIG. 5B is a cross-sectional view of two connectors snap-fit together.

FIG. 5B details the snap-fit connection between a male connector 82 of a first connector 80A and a female connector 84 of a second connector 80B. As will be appreciated by those skilled in the art, a snap-fit is a type of releasable connection that can be achieved when a portion of one or both of the female connector 84 and that male connector 82 moves aside as the connectors are moved into engagement, followed by a return of the moved aside portion of connectors returning toward its original position when the connectors reach their final position relative to each other. The snap-fit with hold the male and female connectors in an engaged state until some appreciable amount of force is used to pull the connectors apart. In this case, the snap-fit is accomplished by one or both of a rim 88 of the male connector 84 and a wall 90 of the female 82 slightly moving as the male connector 84 is inserted into the female connector 82, with the rim 88 and/or the wall 90 snapping back into its original configuration when the female connector 82 and the male connector 84 are set in their final configuration shown in FIG. 5B.

The connector 80 is provided in an area 90 adjacent to the end wall 50 in which the first panel 10 and the second panel 20 are connected together. As noted above, in embodiments of the invention where the paneling of the pouch is formed from plastic, the first and second panels 10 and 20 are connected together through techniques such as heat sealing or mechanical welding. Such techniques stiffen the area 90, which in turn provides a more secure platform for mounting the connector 80 to the pouch.

As shown in FIGS. 2 and 3, a backing panel 25 is provided adjacent to the second panel 20. The backing panel 25 adds stiffness and durability to the pouch, and can be constructed from a variety of materials, such as paper and plastics. In one specific embodiment, the backing panel 25 is made from paperboard with a thickness of b 10 to 20 mils. In this specific example, the paperboard includes about 25% or more of recycled content, thereby improving the environmental characteristics of the pouch.

As discussed above, the panels 10 and 20 of the pouch can be made from substantially transparent plastics. As such, the backing panel 25 will be visible through the panels 10 and 20. The backing panel 25 can be provided in different colors, which in turn may impart different colors to the pouch.

In the embodiment shown in FIGS. 2 and 3, the backing panel 25 is fixed to the surface of the second panel 20 that is opposite to the surface of the second panel that faces the inside of the pouch. The backing panel 25 may be fixed to the second panel 20, for example, with an adhesive or with a mechanical fixture. In alternative embodiments, the backing panel is provided adjacent to the surface of the second panel 20 inside the pouch, with the backing panel thereby enclosed in the pouch structure. In these alternative embodiments, the backing panel 25 may or may not be adhered to the second panel 20. As is apparent from the foregoing description, the backing panel 25 can also be provided adjacent to either surface of the first panel 10.

Figure 6:
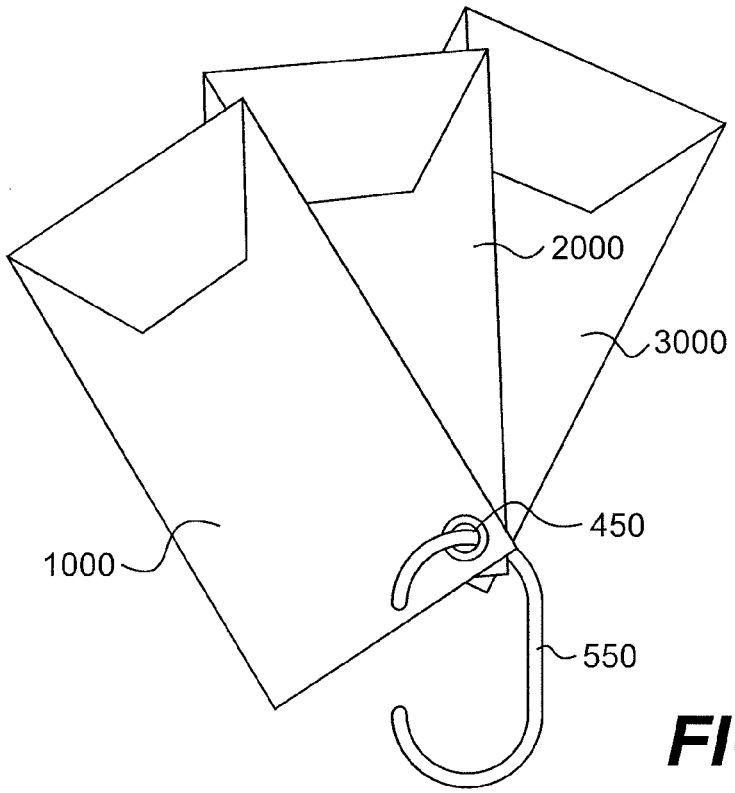
FIG. 6 is a view of a plurality of connected pouches according to an embodiment of the invention.
Figure 7:
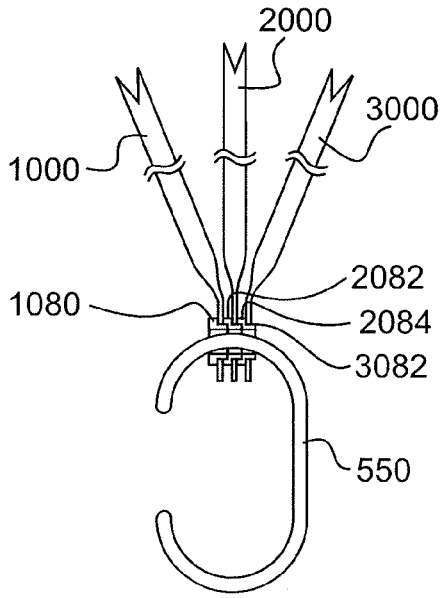
FIG. 7 is a cross-sectional view of the pouches shown in FIG. 6.

FIGS. 6 and 7 show a system of connected pouches according to an embodiment of the invention. As seen in the cross section shown in FIG. 7, the male connector 1080 of a first pouch 1000 is inserted into the female connector 2082 of a second pouch 2000. The male connector 1080 is received by the female connector 2082 with a snap-fit, as described above. Meanwhile, the male connector 2084 of the second pouch 2000 is received by in the female connector 3082 of a third pouch 3000. Thus, a system of connected pouches can be formed without providing any additional structures. Moreover, as will be appreciated from the foregoing description, the universal nature of the connection structures of the pouches 1000, 2000, and 3000 allow for the pouches to be connected in any order, and an unlimited number of other pouches may be further connected to the system.

The connected pouches 1000, 2000, and 3000 can pivot relative to each other about the connection structures. FIG. 6 shows the connected pouches 1000, 2000, and 3000 pivoted relative to each so as to create a fan-like arrangement. As discussed above, the pouches can be made of substantially transparent plastic. Moreover, as also described above, in embodiments of the invention the pouches may have a transparent face and an opposing opaque face. The transparency of the pouches in combination with the fan arrangement allows for the contents of all the connected pouches to be displayed while the pouches are all closed and connected. As such, the contents of the pouches can be easily discerned.

As described above, a passage is formed through the connection structures of pouches according to the invention. When a system of pouches is connected together using the connection structures as shown in FIGS. 6 and 7, the passages of the connectors align so as to form a passage 450 from the pouch 1000 at one end of the system, through to pouch 3000 at the other end of the system. This passage 450 allows for other structures to be easily associated with the system of pouches. An example of such an accessory is shown in FIGS. 6 and 7, wherein a holder 550 is passed through the passage 450 in the connected pouches. The holder 550 could be used, for example, to hang the connected pouches in a convenient place. Examples of other accessories that could be associated with the passage 450 include hooks, pegs, lanyards, and adaptors for associating the system of pouches to other organizational structures such as file cabinets. Still further, even more functionality can be added to the system by providing magnetic structures, labels, filing clips, etc., to the accessories associated with the passage 450 in the connected pouches.

In the embodiment depicted in FIGS. 6 and 7, the pouches 1000, 2000, and 3000 have the same size and shape. In other embodiments of the invention, however, the pouches can be provided in different sizes and shapes. For example, one of the pouches can be a smaller size relative to the other two pouches, another of the pouches can be larger than the other two pouches, and one of the pouches can be made in a medium size that is between the small and large pouches. Along these lines, the length, width, and/or the depth of the pouches can be varied. In a specific example, a small pouch is provided as about 6.5 in. wide and about 6.375 in. tall, a medium pouch is provided as about 6.5 in. wide by about 11.75 in. tall, and a large pouch is provided as about 11.75 in. wide by about 10 in. tall. In this specific example, the pouches include about 0.75 in. deep gussets extending from the first and second panels, which, as described above, allow for an expandable depth. It should also be noted that an opening to the enclosed space of the pouch could be provided along a long or short side of a rectangular pouch, and further, that the pouch as a whole may have a shape other than a rectangle.

Figure 8:
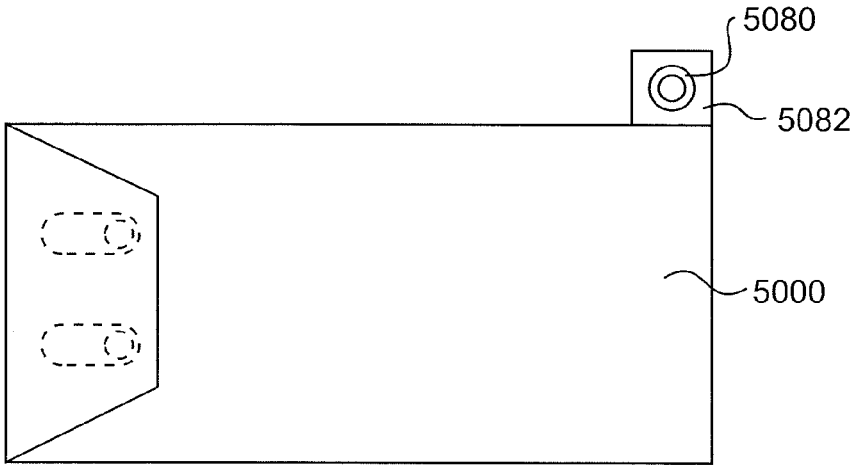
FIG. 8 is a top view of a pouch according to another embodiment of the invention.

A pouch 5000 according to another embodiment of the invention is shown in FIG. 8. In this embodiment, the pouch 5000 is generally configured similar to the pouches described above, except that the connector 5080 is not provided in an area of the first and second panels of the pouch structure. Instead, a connection structure 5080 is provided on an extension 5082 that is provided adjacent to the rest of the pouch structure. As discussed above, the pouch may include a backing panel. In some embodiments, the extension 5082 is formed as part of the backing panel (not shown in FIG. 8) for the pouch. In other embodiments, the extension 5082 is a separate structure that is fixed to rest of the pouch structure. As is readily aparent from the disclosure herein, the extension 5082 can alternatively be formed or placed at other positions relative to the rest of the pouch structure other than the position shown in FIG. 8. Moreover, the extension 5082 itself can be provided in a variety of different shapes.

Figure 9:
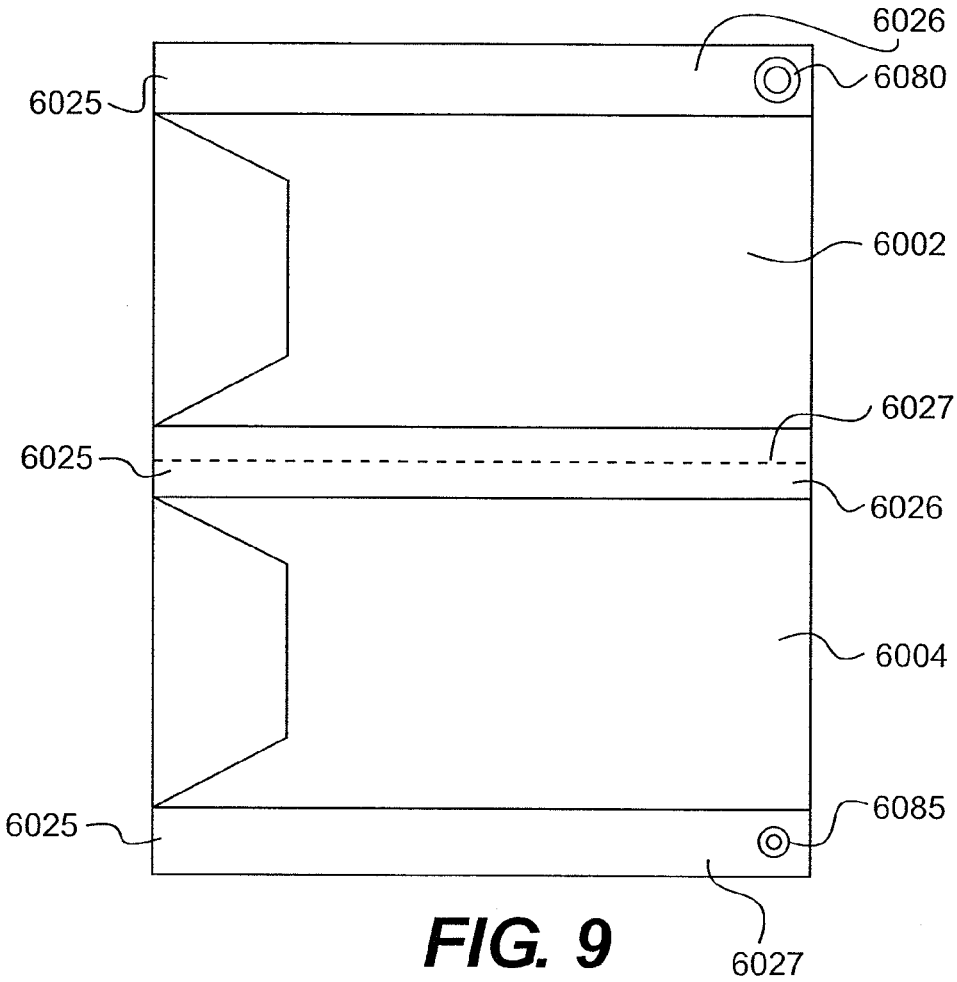
FIG. 9 is a top view of a pouch according to another embodiment of the invention.

A pouch structure 6000 according to yet another embodiment of the invention is shown in FIGS. 9 and 10. In this embodiment, two pouch structures 6002 and 6004 are provided on a common backing panel 6025. The pouch structure 6000 also includes two connection structures 6080 and 6085, which are provided at opposite corners along edges 6026 and 6027 of the backing panel 6025. The backing panel 6025 is also provided with a crease 6027 in a center area 6026 between the pouches 6002 and 6004.

Figure 10A:
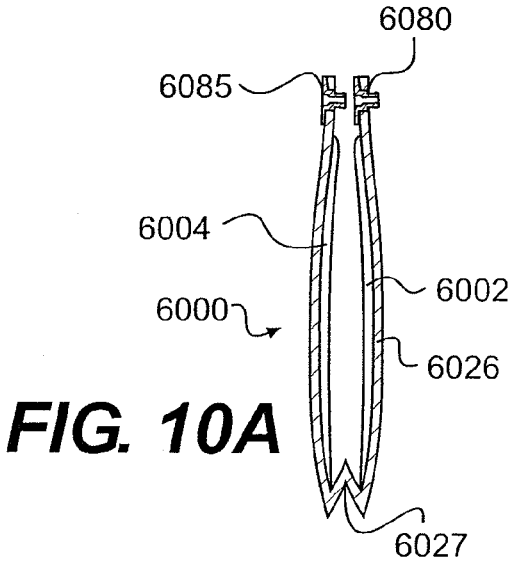
FIGS. 10A and 10B are side views of the pouch shown in FIG. 9.
Figure 10B:
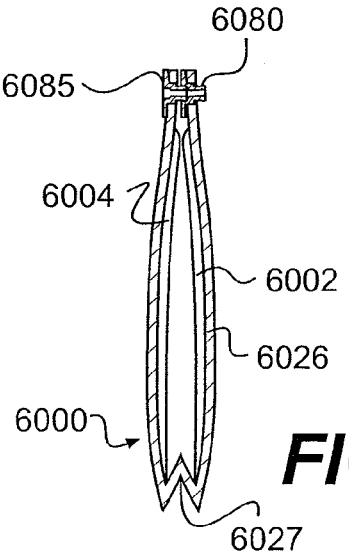

As shown in FIGS. 10A and 10B, the pouch structure 6000 can be folded along crease 6027 such that the pouches 6002 and 6004 face each other. In the folded position shown in FIG. 10B, the male connector of the connection structure 6085 can be inserted into the female connector of connection structure 6080. As such, the pouch structure 6000 is held in the folded position with the snap-fit of connectors 6080 and 6085. Thus, the pouch structure 6000 of this embodiment provides a folder-like arrangement.

Figure 11A:
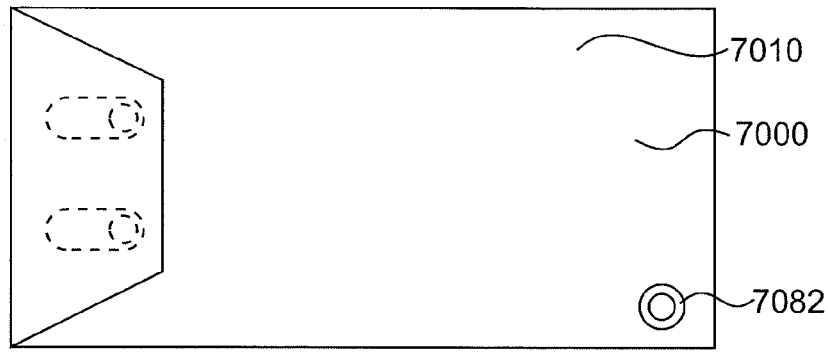
FIG. 11A is a top view of a pouch according a further embodiment of the invention.
Figure 11B:
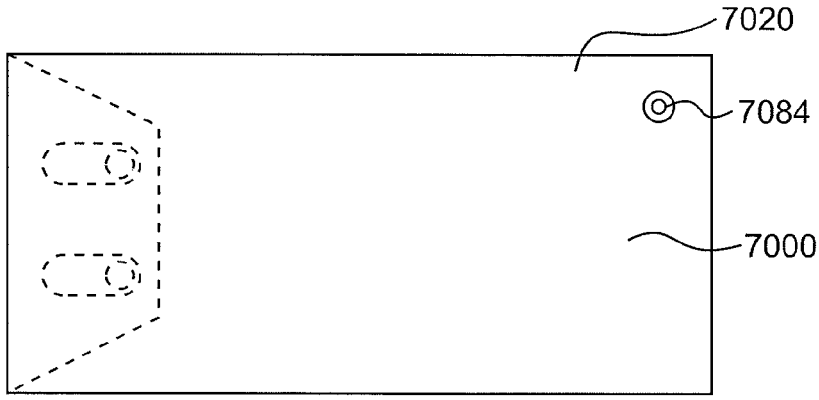
FIG. 11B is another top view of the pouch shown in FIG. 11A.
Figure 12:
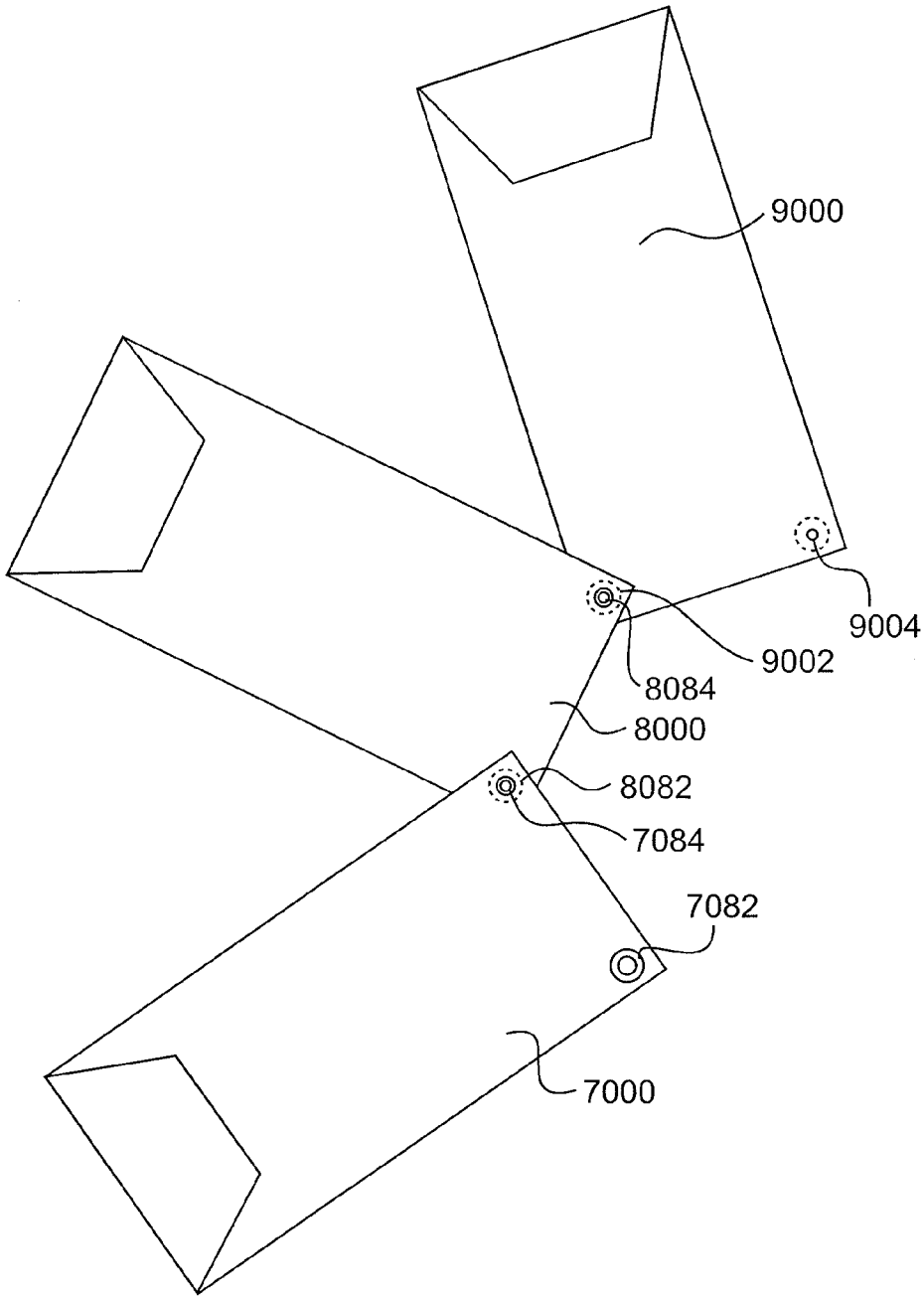
FIG. 12 is a view of a plurality of pouches of the type shown in FIGS. 11A and 11 B, with the pouches connected together.

FIGS. 11A and 11B are top views of the two sides of a pouch 7000 according to yet another embodiment of the invention. In pouch 7000, the female connector 7082 is provided adjacent to panel 7010 at one corner of the pouch, and the male connector 7084 is provided adjacent to the panel 7020 at another corner of the pouch. That is, unlike the embodiments described above, the connectors 7082 and 7084 are separate structures, and not provided opposite to each other on the pouch. FIG. 12 shows a plurality of the pouches 7000, 8000, and 9000, of the type shown in FIGS. 11A and 11B, with the pouches connected by their respective connectors 7082, 7084, 8082, 8084, 9082, and 9084. With the positioning of the connectors on the pouches, the connected pouches 7000, 8000, and 9000 form a chain-like structure.

As will be apparent from the foregoing description, a pouch according to the invention many come in a variety of alternative configurations with different combinations of features. For example, a pouch according to the invention can be provided with two pairs of male and female connectors, with one pair of male and female connectors provided at one corner of the couch, and the other pair of male and female connectors provided at another corner of the pouch. Such an embodiment can be used, for example, to create a chain of connected pouches, or, as another example, to attach accessories that allow the pouch to be hung in a filing cabinet. As another alternative embodiment, a plurality of pouches could be attached to a common backing panel.

The pouch and system of pouches described herein have a multitude of applications, and are particularly useful in organizing items. The pouches can be used to contain numerous items, such as pens and markers, photos, coupons, bills, flash drives, cables, optical disks, business cards, etc. Moreover, the ability of the pouches to be connected together, in turn, allows for grouping of different items together. Accessories associated with the system of pouches further increase the functionality of the invention, for example, by allowing the pouches to be hung in convenient places.

To understand some of the advantages of the present invention, consider life in a modern household. The head(s) of the household often has multiple responsibilities, such as taking care of children, paying bills, updating calendars, managing family records, shopping for food and other necessities, and performing other day-to-day errands. In order to take care of all of these responsibilities, the head of a household must handle a variety of papers, such as coupons, bills, school reports, stamps, etc. The household head may also have access to several other types of small items, for example, optical disks, flash drives, specialized writing instruments such as colored pencils, batteries, etc. The end result is that papers and other items pile up, be it on tables, on counters, in drawers, or in other locations around the house. Thus, keeping related materials together for a specific activity can be very challenging for the head of a household. Multiply that by all the different activities that need to be accomplished, and the challenge might be overwhelming.

Along these lines, consider a hypothetical head of a household who has numerous responsibilities, and is constantly on the go to manage activities stemming from the responsibilities. One task for the hypothetical head of the household might be to buy groceries at the supermarket. In a rush to get to the supermarket before picking children up from school, the head of the household may think to take along coupons recently clipped from the newspaper. The supermarket coupons, however, may be buried in a pile, underneath coupons for other stores. Further, the supermarket coupons might be buried underneath other items. Thus, while the head of the household may remember the supermarket coupons, in the pinch to get to the store, she or he may not have time to find the coupons.

Previously, there were a limited number of organizational tools available to the head of a household to aid with the organization of smaller-sized items, such as coupons. Moreover, the prior art organizational tools that are available, such as standard file folders, are often optimized for standard paper sizes, and are narrowly prescriptive as to where and how they can be used. Other tools, such as larger storage envelopes, are general catch-ails that are hard to search through, and often conceal the items that they contain. With respect to the hypothetical described above, the prior art organization tools might be of little aid to the head of the household in storing and locating the supermarket coupons. For example, while the supermarket coupons could be stored in a file folder, that file folder will most likely conceal the coupons within its structure, and further, the file folder itself may be obscured when stored with other file folders.

On the other hand, the present invention provides a convenient system for storing, grouping, and locating items. As described above, the connectors on pouches according to the invention allow multiple pouches to be grouped together. Further, as also described above, the pouches according to the invention can be made at least partially transparent, and connected pouches positioned relative to each other for easy determination of their contents. Thus, the contents of pouches can be quickly located.

Returning to the hypothetical, the supermarket coupons could be stored in a pouch according to the invention. The pouch, in turn could be connected with pouches containing other coupons, and, with the holder described above, hung in a convenient place. With at least part of the pouch being made transparent, and with an arrangement of the connected pouches, the head of the household can quickly find the pouch that contains the supermarket coupons. Moreover, if desired, the pouch containing the supermarket coupons could be removed from the group, and the head of the household can use the pouch to carry the coupons on the way to the supermarket.

Of course, while the foregoing provides examples of the utility and convenience of the present invention, particularly in the context of home administration, the present invention has many other uses in other contexts and other places, such as in an office or other business. Along these lines, although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

We claim:

1. A system of pouches comprising:

(a) a common backing panel;

(b) a first pouch attached to one side of the common barking panel, the first pouch comprising a first panel and a second panel, the first panel and the second panel being connected to each other to form an enclosed space with an opening to the enclosed space, and a flap extending from the second panel, wherein the flap is movable between (i) an extended position in which the opening to the enclosed space is accessible, and (ii) a folded position in which the opening to the enclosed space is closed;

(c) a second pouch attached to the same side of the common backing panel as the first pouch, the second pouch comprising a first panel and a second panel, the first panel and the second panel being connected to each other to form an enclosed space with an opening to the enclosed space, and a flap extending from the second panel, wherein the flap is movable between (i) an extended position in which the opening to the enclosed space is accessible, and (ii) a folded position in which the opening to the enclosed space is closed;

(d) a one-piece, integral first connection structure comprising a fist side and a second side, and connected to the common backing panel in an area adjacent to the first pouch, the first connection structure including (i) a female connector provided on the first side of the first connection structure that is on the same side of the backing panel as the first pouch and the second pouch, and (ii) a male connector provided on the second side of the first connection structure that is on a side of the backing panel that is opposite to the side with the female connector; and (e) a one-piece, integral second connection structure comprising a fist side and a second side, and connected to the common backing panel in an area adjacent to the second pouch, the second connection structure including (i) a male connector provided on the first side of the second connection structure that is on the same side of the backing and as the female connector of the first connection structure, and (ii) a female connector provided on the second side of the second connection structure that is on the side of the backing panel with the male connector of the first connection structure, wherein the common backing panel is configured to fold along a crease in an area between the first pouch and the second pouch, the common backing panel folding from a position where (i) the female connector of the first connection structure and the male connector of the second connection structure are separated from each other, to (ii) a position where a portion of the male connector of the second connection structure is received within the female connector of the first connection structure.

2. A system of pouches according to claim 1, wherein the backing panel is formed from one of (i) paper, (ii) paperboard, and (iii) plastic.

3. A system of pouches according to claim 1, wherein the backing panel is formed from paperboard and includes about 25% or more of recycled content.

4. A system of pouches according a claim 1, wherein at least one of the first pouch and the second pouch is substantially transparent.

5. A system of pouches according to claim 1, wherein a hole is formed in the female connector and the male connector of the first connection structure, wherein a hole is formed in the female connector and the male connector of the second connection structure, and wherein, when the female connector of the first connection structure receives the male connector of the second connection structure, the holes in the male connectors and the holes in the female connectors align with each other such that a hole is formed through the backing panel.

6. A system of pouches according to claim 5, further comprising at least one structure configured to be placed through the hole formed through the backing panel.

7. A system of pouches according to claim 6, wherein the at least one structure includes at least one of (i) a hook, (ii) a peg, (iii) a lanyard, (iv) a binder ring, and (v) a structure that includes a mounting structure.

8. A system of pouches according to claim 1, wherein the opening of the first pouch is along a first side of the first pouch, and the first connection structure is positioned adjacent to a second side of the first pouch that is opposite to the first side, and wherein the opening of the second pouch is along a first side of the second pouch, and the second connection structure is positioned adjacent to a second side of the second pouch that is opposite to the first side.

9. A folder comprising:

(a) a common backing panel having a crease;

(b) a first pouch attached to the common backing panel on a first side of the crease, the first pouch comprising a first panel and a second panel, the first panel and the second panel being connected to each other to form an enclosed space with an opening to the enclosed space, and a flap extending from the second panel, wherein the flap is movable between (i) an extended position in which the opening to the enclosed space is accessible, and (ii) a folded position in which the opening to the enclosed space is closed;

(c) a second pouch attached to the common hacking panel on a second side of the crease, the second pouch comprising a first panel and a second panel, the first panel and the second panel being connected to each other to form an enclosed space with an opening to the enclosed space, and a flap extending from the second panel, wherein the flap is movable between (i) an extended position in which the opening to the enclosed space is accessible, and (ii) a folded position which the opening to the enclosed space is closed;

(d) a one-piece, integral first connection structure comprising a male connector provided on a first side of the first connection structure, the male connector attached to the common backing panel at a corner on the first side of the crease, with a hole farmed in the male connector; and (e) a one-piece, integral second connection structure comprising a female connector provided on a first side of the second connection structure, the female connector attached to the common backing panel at it corner on the second side of the crease, with a hole formed in the female connector, wherein the common backing panel can be folded alone the crease so as to position the first pouch adjacent to the second pouch and to position a portion of the male connector within the female connector, with the hole of the male connector being aligned with the hole of the female connector, such that a hole is formed through the folder.

10. A folder according to claim 9, wherein at least one of the first pouch and the second pouch is substantially transparent.

11. A folder according to claim 9, further comprising at least one structure configured to be placed through the hole formed through the backing panel.

12. A folder according to claim 11, wherein the at least one structure includes at least one of (i) a hook, (ii) a peg, (iii) a lanyard, (iv) a binder ring, and (v) a structure that includes a mounting structure.

13. A folder according to claim 9, wherein the backing panel is formed from one of (i) paper, (ii) paperboard, and (iii) plastic.

14. A folder according to claim 9, wherein the backing panel is formed from paperboard and includes about 25% or more of recycled content.

15. A folder according to claim 9, wherein the opening of the first pouch is along a first side of the first pouch, and the male connector is positioned adjacent to a second side of the first pouch that is opposite to the first side, and wherein the opening of the second pouch is along a first side of the second pouch, and the female connector is positioned adjacent to a second side of the second pouch that is opposite to the first side.

16. A system of pouches comprising:

(a) a common backing panel;

(b) a fist pouch attached to one side of the common backing panel, the first pouch comprising a first panel and a second panel, the first panel and the second panel being connected to each other to form an enclosed space with an opening to the enclosed space, and a flap extending from the second panel, wherein the flap is movable between (i) an extended position in which the opening to the enclosed space is accessible, and (ii) a folded position in which the opening to the enclosed space is closed;

(c) a second pouch attached to the same side of the common backing panel as the first pouch, the second pouch comprising a first panel and a second panel, the first panel and the second panel being connected to each other to form an enclosed space with an opening to the enclosed space, and a flap extending from the second panel, wherein the flap is movable between (i) an extended position in which the opening to the enclosed space is accessible, and (ii) a folded position in which the opening to the enclosed space is closed;

(d) a one-piece, integral first connection structure comprising a first side and a second side, and connected to the common backing panel in an area adjacent to the first pouch, the first connection structure including (i) a first part provided on the first side of the first connection structure that is on the same side of the backing panel as the first pouch and the second pouch, and (ii) a second part provided on the second side of the first connection structure that is on a side of the backing panel that is opposite to the side with the first part; and (e) a one-piece, integral second connection structure comprising a first side and a second side, and connected to the common backing panel in an area adjacent to the second pouch, the second connection structure including (i) a second part provided on the first side of the second connection structure that is on the same side of the backing panel as the first hart of the first connection structure, and (ii) a first part provided on the second side of the second connection structure that is on the side of the backing panel as the second pan of the first connection structure, wherein the common backing panel is configured to fold along a crease in an area between the first pouch and the second pouch, the common backing panel folding from a position where (i) the first part of the first connection structure and the second part of the second connection structure are separated from each other, to (ii) a position where the second part of the second connection structure is received within the first part of the first connection structure.

17. A system of pouches according to claim 16, wherein the second part of the first connection structure is configured to be received by a connection structure having a first part with the same configuration as the first part of the first connection structure, and wherein the first part of the second connection structure is configured to receive a connection structure with a second part having the same configuration as the second part of the second connection structure.

18. A system of pouches according to claim 16, wherein the first parts of the first and second connection structures are female connectors, and wherein the second parts of the first and second connection structures are male connectors.

19. A folder according to claim 16, wherein at least one of the first pouch and the second pouch is substantially transparent.

20. A folder according to claim 16, wherein the backing panel is formed from one of (i) paper, (ii) paperboard, and (iii) plastic.

21. A folder according to claim 16, wherein the backing panel is formed from paperboard and includes about 25% or more of recycled content.

22. A system of pouches according to claim 16, wherein the opening of the first pouch is along a first side of the first pouch, and the first structure is positioned adjacent to a second side of the first pouch that is opposite to the first side, and wherein the opening of the second pouch is along a first side or the second pouch, and the second connection structure is positioned adjacent to a second side of the pouch that is opposite to the first side.

* * * * *